US006918348B2

(12) United States Patent
Matsuda et al.

(10) Patent No.: US 6,918,348 B2
(45) Date of Patent: Jul. 19, 2005

(54) PERSONAL WATERCRAFT

(75) Inventors: Yoshimoto Matsuda, Kobe (JP); Yoshiyuki Kuroyanagi, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/346,417

(22) Filed: Jan. 16, 2003

(65) Prior Publication Data

US 2003/0140833 A1 Jul. 31, 2003

(30) Foreign Application Priority Data

Jan. 25, 2002 (JP) ..... 2002-017011
Jan. 28, 2002 (JP) ..... 2002-017874

(51) Int. Cl.[7] ..... B63B 17/00
(52) U.S. Cl. ..... 114/363; 114/55.57
(58) Field of Search ..... 114/55.55–55.57, 114/363, 362; 440/88 A

(56) References Cited

U.S. PATENT DOCUMENTS 3,982,497 A * 9/1976 Caron ..... 114/55.51
5,588,887 A * 12/1996 Ikeda ..... 440/88 L
5,735,229 A * 4/1998 House et al. ..... 114/363
5,957,072 A * 9/1999 Hattori ..... 114/55.57

* cited by examiner

*Primary Examiner*—Ed Swinehart
(74) *Attorney, Agent, or Firm*—Alleman Hall McCoy Russell & Tuttle LLP

(57) ABSTRACT

Disclosed is a watercraft comprising a body; a hull constituting a lower portion of the body; a deck having deck floors formed on both sides of the body in a width direction and a raised portion at least extending from a center portion of the body to a rear end portion of the body in a longitudinal direction and being raised from center-side end portions of the deck floors on both sides in the width direction so as to form an engine room that contains the engine, the deck covering the hull from above and constituting an upper portion of the body; a straddle-type seat mounted over an upper end of the raised portion of the deck for a rider to straddle with feet put on the deck floors on both sides; and a rear cowling mounted behind the seat and extending rearwardly from a rear end of the seat.

14 Claims, 13 Drawing Sheets

PERSONAL WATERCRAFT

BACKGROUND OF THE INVENTION

1. Field of the Invention

The present invention relates to a straddle-type personal watercraft (PWC) which ejects water rearward and planes on a water surface as the resulting reaction, and more particularly to a structure of a rear portion of the personal watercraft.

2. Description of the Related Art

In recent years, so-called jet-propulsion personal watercraft have been widely used in leisure, sport, rescue activities, and the like. The personal watercraft is configured to have a water jet pump that pressurizes and accelerates water sucked from a water intake generally provided on a hull bottom surface and ejects it rearward from an outlet port. Thereby, the personal watercraft is propelled.

In the jet-propulsion personal watercraft, a steering nozzle provided behind the outlet port of the water jet pump is swung either to the right or to the left by operating a bar-type steering handle to the right or to the left, to change the ejection direction of the water to the right or to the left, thereby turning the watercraft to the right or to the left.

The personal watercraft for leisure or sport activities is required to reduce fluid resistance of a body because of its high-speed cruising. In addition to its improved functionality, such a personal watercraft is required to improve its external design appearance and increase its commercial value. As a matter of course, the personal watercraft that is comfortable to ride on is preferred to a passenger riding on a rear portion of a seat. Further, for easier maintenance, it is desirable to arrange components at positions to be readily accessible by an operator.

Since the personal watercraft is small and planes on the water surface, water is always splashing around the watercraft during cruising. During cruising in such a situation, air (ambient air) free from water needs to be supplied into an engine room provided inside the watercraft to operate the engine.

As a solution to this, there have been proposals in the prior art. For example, Japanese Patent No. 2648667 discloses that a gap is created between a seat and a raised deck portion to allow ambient air to be taken into an engine room therethrough. U.S. Pat. No. 5752867 discloses that a handgrip portion extending from a rear end of a straddle-type seat of the watercraft is configured to have a hollow portion and the rear end of the hollow portion is opened to ambient side, to allow ambient air to be taken into the engine room through the handgrip.

However, in the former structure, it is necessary to provide a complex labyrinth structure inside the engine room continuous with the gap for the purpose of removing water splash entering the engine room through the gap between the seat and the deck portion and preventing water ingress into the engine room through the gap when the watercraft is inverted. This results in the deck portion of a complex structure. In the latter structure, the handgrip contains a labyrinth structure for preventing water ingress and therefore is complex in structure.

SUMMARY OF THE INVENTION

The present invention addresses the above-described conditions, and an object of the present invention is to provide a personal watercraft which is capable of reducing fluid resistance, has excellent external design appearance, is comfortable for a passenger to ride on, and has components arranged to be readily accessible by an operator for maintenance. Another object of the present invention is to provide a personal watercraft capable of taking in ambient air free from water into an engine room with a simple structure using a rear cowling for improved external design appearance or a handgrip member.

According to the present invention, there is provided a personal watercraft propelled by an engine, comprising: a body; a hull constituting a lower portion of the body; a deck having deck floors formed on both side portions of the body in a width direction and a raised portion at least extending from a center portion of the body to a rear end portion of the body in a longitudinal direction and being raised from center-side end portions of the deck floors on both sides in the width direction, so as to form an engine room inside thereof that contains the engine, the deck covering the hull from above and constituting an upper portion of the body; a straddle-type seat mounted over an upper end of the raised portion of the deck for a rider to straddle with feet put on the deck floors on both sides; and a rear cowling mounted behind the seat and extending rearwardly from a rear end of the seat.

In accordance with the personal watercraft, the rear cowling extends rearwardly from the rear portion of the seat. This reduces vortex, which is generated behind the seat and is a cause of an increase in fluid resistance, and hence the fluid resistance during cruising. Also, the external design appearance of the personal watercraft is improved.

Preferably, an upper face of the rear cowling may be configured to be higher than an upper face of a rear portion of the seat and a cushion member may be provided on a front face (tip-end face) of the rear cowling. In this structure, the cushion member supports the hip or waist of the passenger riding on the rear portion of the seat from behind. When the rear cowling has a sufficient height, the passenger can lean back against the front face of the rear cowling and, therefore, feels comfortable to ride on the watercraft.

Preferably, an accommodating portion may be formed inside the rear cowling and a battery may be accommodated inside the accommodating portion of the rear cowling. With this structure, a level of an electrolyte of the battery is easily checked and maintenance of the battery is easily performed when necessary.

Preferably, a handgrip member may be attached to a rear portion of the rear cowling. The handgrip can be used as a handgrip for the passenger.

Preferably, a gap may be formed between the rear cowling and the seat or the rear cowling and the raised portion of the deck so as to communicate with an ambient side, and an air-intake chamber may be formed inside the rear cowling to communicate with the gap and to allow the air-intake chamber and the engine room to communicate with each other.

In this structure, by setting a dimensional relationship between the seat or the deck and the rear cowling to create the gap between the seat or the deck and the rear cowling, the ambient air is taken in through the gap and flows through an inside of the air-intake chamber located inside the rear cowling to be supplied into the engine room. Also, by attaching the rear cowling to the seat or the deck side so as to cover the seat or the deck portion with the gap, if water splashes from outside to the rear cowling, it does not deeply flow into the gap. Even if the water deeply flows into the gap, it does not further flow into the air-intake chamber therefrom. This structure effectively prevents water ingress into the engine room. As a matter of course, the accommodating portion may be used as the air-intake chamber.

Preferably, the air-intake chamber may be connected to the engine room through an air passage and an upper end of the air passage upwardly protrudes from a bottom portion of the air-intake chamber. In this structure, water flowing into the air-intake chamber where the upper end of the air passage is located is effectively prevented from further flowing into the air passage because the upper end of the air passage is located higher than the bottom portion of the air-intake chamber.

Preferably, the air-intake chamber may be connected to the engine room through the air passage and a lower end of the air passage extends to a lower portion inside the engine room. In this structure, when the watercraft is in an almost inverted state, the water ingress into the engine room is effectively prevented because the lower end of the air passage is located higher than a waterline of the inverted watercraft. In addition to this structure, by arranging the air passages obliquely, the water ingress into the engine room is more effectively prevented when the watercraft is in the almost inverted state.

Preferably, the air-intake chamber may be connected to the engine room through two air passages which are arranged so as to cross each other. In this structure, the air is smoothly supplied into the engine room through the right and left air passages, and the water ingress into the engine room is more effectively prevented when the watercraft is in the almost inverted state.

According to the present invention, there is also provided a personal watercraft propelled by an engine, comprising: a body; a hull constituting a lower portion of the body; a deck having deck floors formed on both side portions of the body in a width direction and a raised portion at least extending from a center portion of the body to a rear end portion of the body in a longitudinal direction and being raised from center-side end portions of the deck floors on both sides in a width direction so as to form an engine room inside thereof that contains the engine, the deck covering the hull from above and forming an upper portion of the body; a straddle-type seat mounted over an upper end of the raised portion of the deck for a rider to straddle with feet put on the deck floors on both sides; and a rear-attachment mounted behind the seat and having a hand grip held by a passenger straddling a passenger seat; a gap formed between a mounting portion of the rear attachment to the deck and an outer face of the raised portion of the deck to communicate with ambient air outside the watercraft; and an air-intake chamber provided inside the rear attachment and continuously with the gap at a position away from the ambient side so as to have a bottom and to communicate with the engine room.

In this structure, by setting a relative dimensional relationship between the mounting portion of the rear attachment to the deck and the raised portion of the deck to create the gap between them, the ambient air is taken in through the gap into the air-intake chamber that is continuous with the gap and away from the ambient side and then into the engine room. Also, the air-intake chamber continuous with the gap has the bottom portion. Therefore, if the water splash enters the air-intake chamber, the water ingress into the engine room can be effectively prevented by inclining the bottom portion and causing the air-intake chamber to communicate with the engine room at a relatively high position of the inclined bottom.

Preferably, the air-intake chamber may be connected to the engine room through an air passage and an upper end of the air passage may upwardly protrude from a bottom portion of the air-intake chamber. In this structure, when water flows into the air-intake chamber where the upper end of the air passage is located, water ingress into the air passage is effectively prevented because the upper end of the air passage is located higher than the bottom portion of the air-intake chamber.

Preferably, the air-intake chamber may be connected to the engine room through the air passage and a lower end of the air passage may extend to a lower portion inside the engine room. In this structure, when the watercraft is in almost inverted state, the water ingress into the engine room is effectively prevented because the lower end of the air passage is located higher than the waterline of the inverted watercraft. By arranging the air passage obliquely, the water ingress into the engine room is more effectively prevented.

Preferably, the air-intake chamber may be connected to the engine room through two right and left air passages arranged to cross each other. In this structure, air is smoothly supplied into the engine room through the right and left air passages, and the water ingress into the engine room is effectively prevented when the watercraft is in almost inverted state.

Preferably, the right and left air passages may be integral with each other and attached to an inner face of the deck. In this structure, since the two air passages are in a sub-assembly state prior to being attached to the inner face of the deck, such integrated passages can be easily assembled, removed, and positioned.

Preferably, the air passage may be formed integrally inside a board member and the board member is attached to the inner face of the deck. In this structure, since the two air passages are in a sub-assembly state prior to being attached to the inner face of the deck, such integrated passages can be easily assembled, removed, and positioned. In addition, the air passages are compactly arranged in the engine room.

The above and further objects and features of the invention will be more fully be apparent from the following detailed description with accompanying drawings.

DETAILED DESCRIPTION OF PREFERRED EMBODIMENTS

Hereinafter, embodiments of a personal watercraft of the present invention will be described with reference to the accompanying drawings.

Figure 16:
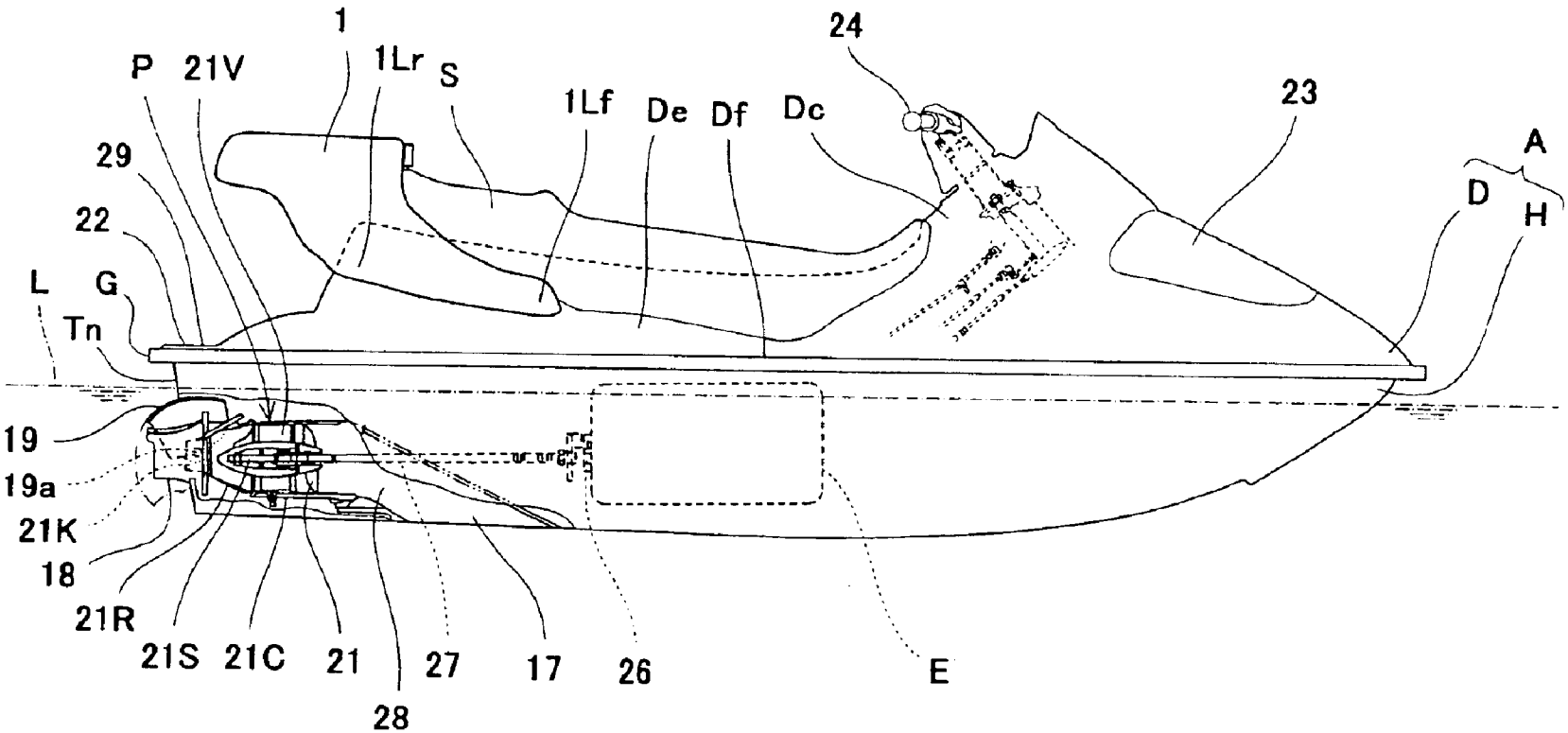
FIG. 16 is a side view of an entire jet-propulsion personal watercraft according to the embodiment of the present invention.
Figure 17:
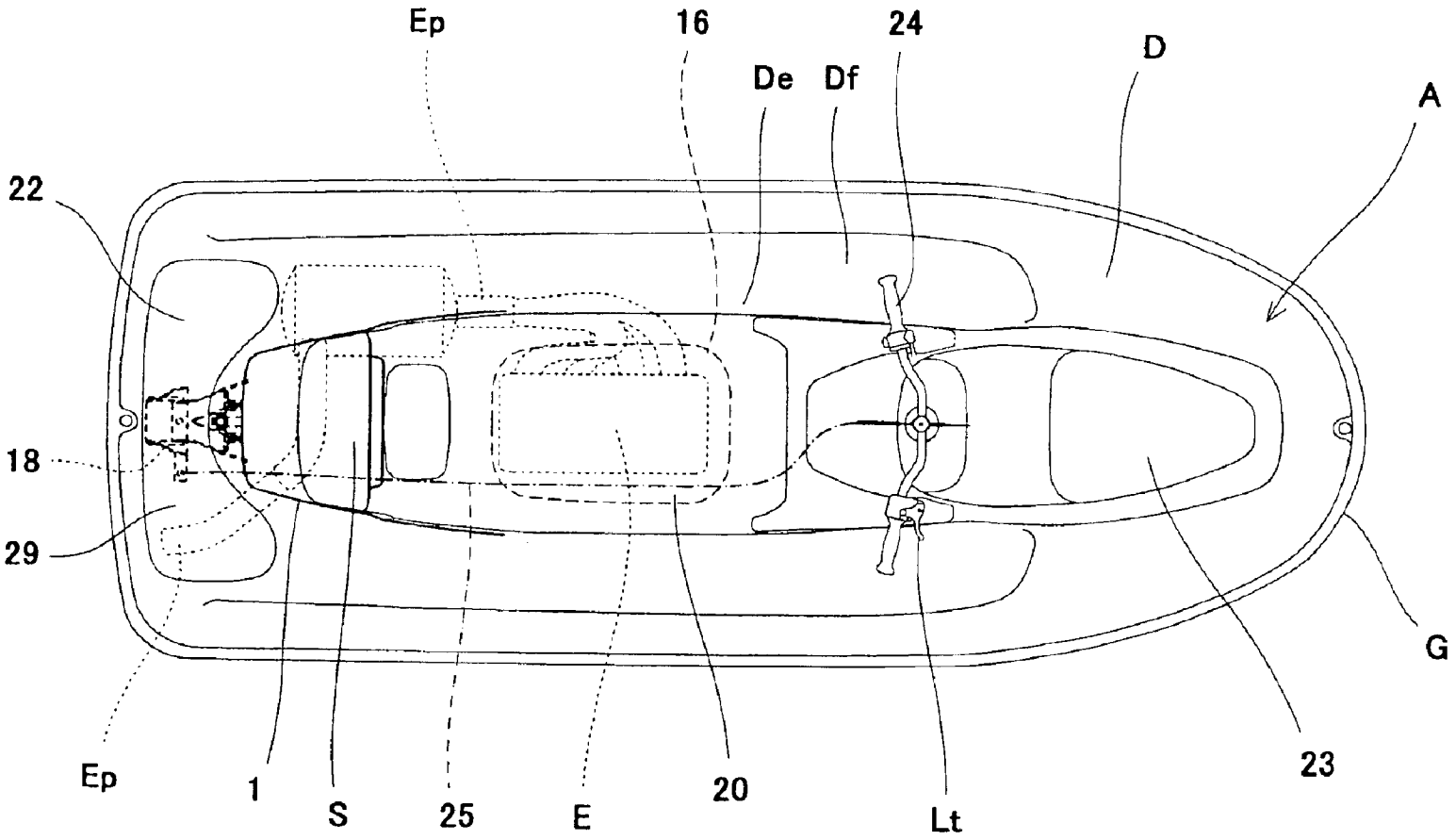
FIG. 17 is a plan view of the entire personal watercraft in FIG. 16.

Referring now to FIGS. 16 and 17, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 17, an opening 16, which has a substantially rectangular shape seen from above, is formed at a relatively rear section of the deck D such that it extends in the longitudinal direction of the body A, and a riding seat S is mounted above the opening 16 such that it covers the opening 16 from above as shown in FIGS. 16 and 17.

An engine E is contained in a chamber 20 surrounded by the hull H and the deck D below the seat S and having a convex shape in a cross-section of the body.

The chamber 20 constituting the engine room is formed between the hull H and a raised portion De of the deck D. The deck D is configured such that the raised portion De is raised substantially from a center portion to a rear end portion in the longitudinal direction and substantially between a center-side end portion of a deck floor Df on the right side and a center-side end portion of the deck floor Df on the left side in the width direction. The riding seat S is mounted over an upper end of the raised portion De. The deck floors Df for the rider and the passenger to put feet thereon are provided on both sides of the raised portion De. Forward of and continuous with the raised portion De, a console portion Dc is raised forwardly and obliquely. A bar-type steering handle 24, meters (not shown) and the like are arranged on the console portion Dc.

The engine E includes multiple cylinders (e.g., four cylinders) and is a fuel-injection type. As show in FIG. 16, a crankshaft 26 of the engine E is mounted along the longitudinal direction of the body A. An output end of the crankshaft 26 is rotatably coupled integrally with a pump shaft of a water jet pump P through a propeller shaft 27. An impeller 21 is mounted on the pump shaft of the water jet pump P. The impeller 21 is covered with a pump casing 21C on the outer periphery thereof. A water intake 17 is provided on the bottom of the hull H. The water is sucked from the water intake 17 and fed to the water jet pump P through a water intake passage 28. The water jet pump P pressurizes and accelerates the water. The pressurized and accelerated water is discharged through a pump nozzle 21R having a cross-sectional area of flow gradually reduced rearward, and from an outlet port 21K provided on the rear end of the pump nozzle 21R, thereby obtaining the propulsion force.

In FIG. 16, reference numeral 21V denotes fairing vanes for fairing water flow behind the impeller 21. By operating the steering handle 24 to the right or to the left, the steering nozzle 28 provided behind the pump nozzle 21R swings to the right or to the left through a wire cable 25. The watercraft can be turned in any desired direction while the water jet pump P is generating the propulsion force. A throttle lever Lt is mounted on the right end portion of the handle 24.

As shown in FIG. 16, a bowl-shaped reverse deflector 19 is provided above the rear side of the steering nozzle 18 such that it can swing downward around a horizontally mounted swinging shaft 19*a*. The deflector 19 is swung downward toward a lower position behind the steering nozzle 18 to deflect the water ejected from the steering nozzle 18 forward and, as the resulting reaction, the personal watercraft moves rearward.

In FIGS. 16 and 17, reference numeral 22 denotes a rear deck. The rear deck 22 is provided with an operable hatch cover 29. A rear compartment (not shown) with a small capacity is provided under the hatch cover 29. Reference numeral 23 denotes a front hatch cover. A front compartment (not shown) is provided under the front hatch cover 23 for storing equipment and the like.

Figure 1:
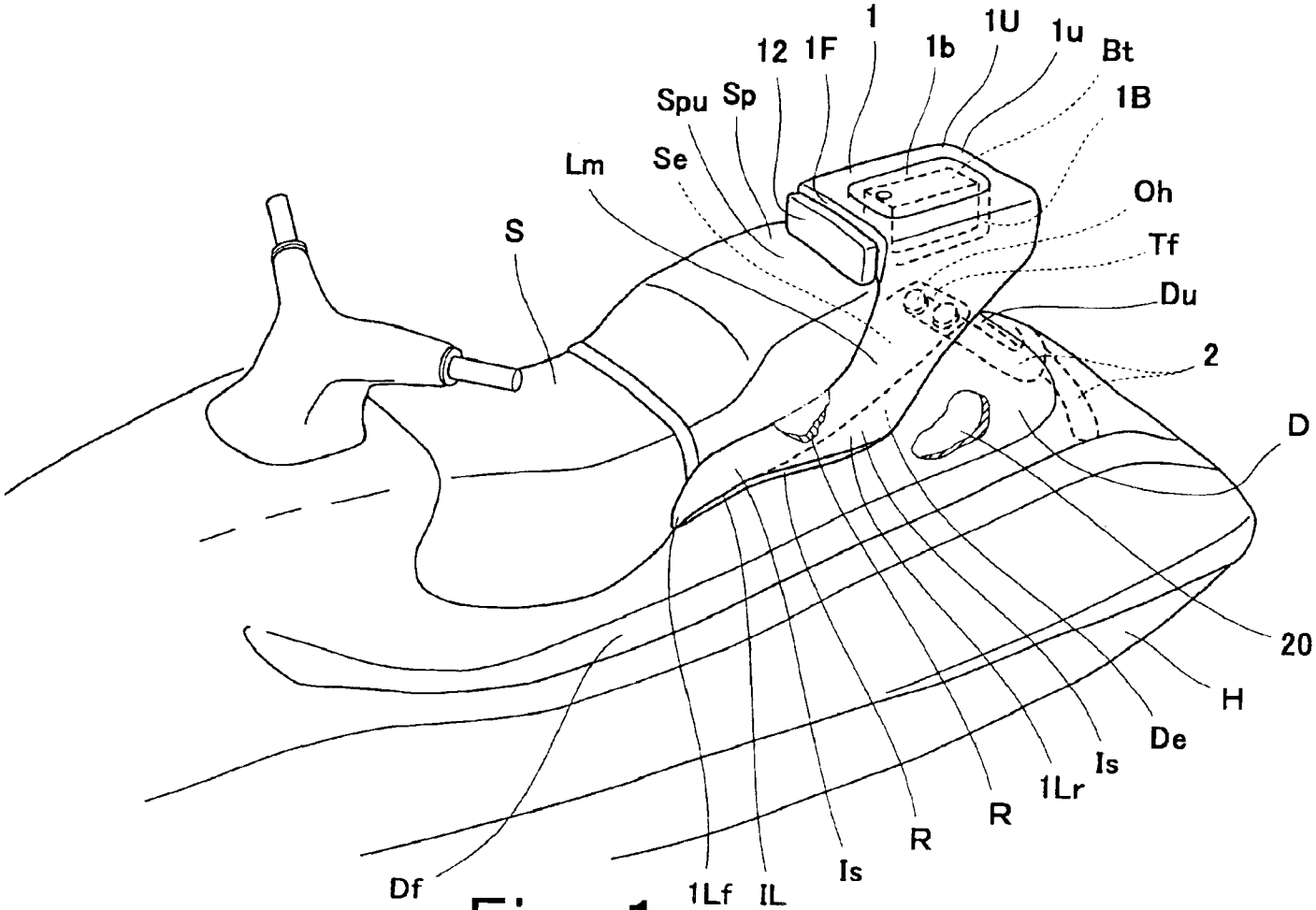
FIG. 1 is a partial perspective view of a personal watercraft showing a structure of rear cowling and an air-intake structure of the personal watercraft according to an embodiment of the present invention, with a front portion of the watercraft omitted and a deck portion being partially cutaway to show an engine room portion.

In the personal watercraft according to an embodiment of the present invention, as shown in FIG. 1, a rear cowling 1 is provided adjacent a rear end portion of the seat S. More specifically, the rear cowling 1 is mounted behind a passenger seat portion Sp of the seat S such that its front end 1Lf extends downwardly to the underside of the passenger seat portion Sp and its rear end 1Lr of a lower end 1L of the rear cowling 1 is located substantially below the rear end of the passenger seat portion Sp. An upper end 1U of the rear cowling 1 is flat and forms an upper end face 1*u*.

The rear cowling 1 slopes upwardly and rearwardly from the rear end 1Lr of the lower end 1L to an accommodating box portion (chamber) 1B in an upper portion thereof. In other words, the rear cowling 1 has the box portion 1B having a front face corresponding to a front face 1F of the rear cowling 1, and both side faces of the box portion 1B extend forwardly and downwardly to cover a lower portion of the rear portion of the seat S and a rear portion (to be precise, part of the rear portion) of the raised portion De forming an outer wall of the chamber (engine room) 20 from their outer sides.

The upper end face 1*u* of the rear cowling 1 is located higher than an upper end face Spu of the passenger seat portion Sp. At a step portion between the upper end face 1*u* of the rear cowling 1 and the upper end face Spu of the passenger seat portion Sp, a cushion member 12 is provided over the entire front face 1F of the upwardly protruding rear cowling 1.

The rear cowling 1 is shaped such that a front portion of the upper end portion has a width approximately equal to the width of the rear end of the seat S (to be precise, slightly larger for covering) and a lower portion of the front portion has a width approximately equal to the width of the corresponding seat S portion and the width between outer walls on both sides of the raised portion De forming the outer walls of the chamber 20 (to be precise, slightly larger by a gap (suction port) R formed between the rear cowling 1 and the raised portion De).

Inside of the box portion 1B, a box-shaped chamber with a bottom is formed. For example, a battery Bt of the personal watercraft is accommodated in this portion. A lid member 1*b* is openably (or removably) attached onto an upper surface of the box portion 1B.

Alternatively, the inside of the box portion 1B may be used as a chamber for accommodating other components, members, or tools. As shown in FIG. 1 or 16, the rear cowling 1 is designed to have a smooth stream line Lm as seen in a side view extending rearwardly from the seat S or the raised portion De of the deck D, except the step portion of the front face 1F.

In this structure, an air-intake chamber Se is provided below the box portion 1B such that it is covered from above and sides by the rear cowling 1 and its bottom portion (surface) is defined by an outer face of the raised portion De of the deck D. Openings Oh are provided in the bottom surface of the air-intake chamber Se formed by the raised portion De so as to communicate with the chamber 20. The air-intake chamber Se communicates with the gap (suction port) R between the rear cowling 1 and the outer face of the raised portion De to allow ambient air from outside to be supplied into the chamber 20. A detail of an air-intake structure for supplying ambient air into the chamber 20 through the air-intake chamber Se will be described later.

In accordance with the personal watercraft so configured, since the battery Bt is accommodated in the box portion 1B as part of the rear cowling 1, inspection of electrolyte of the battery Bt is easily performed by opening the lid member 1*b*. In addition, when maintenance such as charging is needed, the battery Bt can be easily taken out of the box portion 1B.

By placing the rear cowling 1 behind the seat S, fluid resistance is reduced. In addition, external design appearance of the personal watercraft is improved and its commercial value is increased.

Further, by providing the step portion between the seat S and the rear cowling 1 to provide the cushion member 12 on the front face IF of the upwardly protruding rear cowling 1, the hip and waist of the passenger riding on the passenger seat portion Sp of the seat S is supported from behind. This makes the passenger riding on the watercraft feel comfortable. By locating the step portion higher than the structure in FIG. 1 so as to reach the waist and back of the passenger, the waist and back of the passenger can be supported from behind. Such a structure makes the passenger feel less tired. In this case, since the box portion 1B is correspondingly located higher, an internal volume of the box portion 1B is increased.

Figure 2:
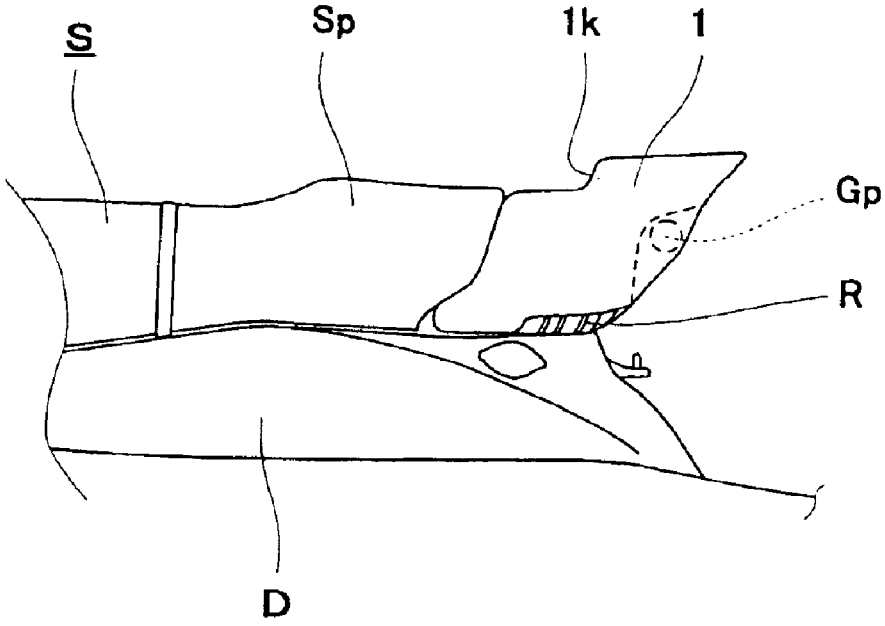
FIG. 2 is a partial side view of an upper portion of a rear end of a personal watercraft, showing a structure of a rear cowling portion according to another embodiment.

Alternatively, as shown in FIG. 2, the extending portion of the rear cowling 1 extending downwardly to the underside of the passenger seat portion Sp may be dispensed with. This results in a simplified rear cowling 1, but almost the same functions and effects as those in the structure in FIG. 1 are provided.

In this structure, the rear cowling 1 is provided with a step portion 1K at the center position in the longitudinal direction thereof. Further, as indicated by a broken-line arrow in FIG. 2, a bar-shaped grip Gp is provided at a position of the rear cowling 1 that opens rearwardly so as to extend in the lateral direction of the watercraft. With such a structure, when the passenger seat portion Sp is short and therefore the hip of the passenger partially protrudes toward the rear cowling 1, part of the rear cowling 1 becomes a seat for the passenger to sit thereon. The hand grip Gp is used as a grip with which the rider (or passenger) to ride on the personal watercraft from behind the watercraft or a hand grip with which the passenger is stabilized on the watercraft. In FIG. 2, R denotes a gap (suction port) formed in the rear cowling 1 through which ambient air is suctioned into the chamber 20 (see FIG. 17).

Figure 3:
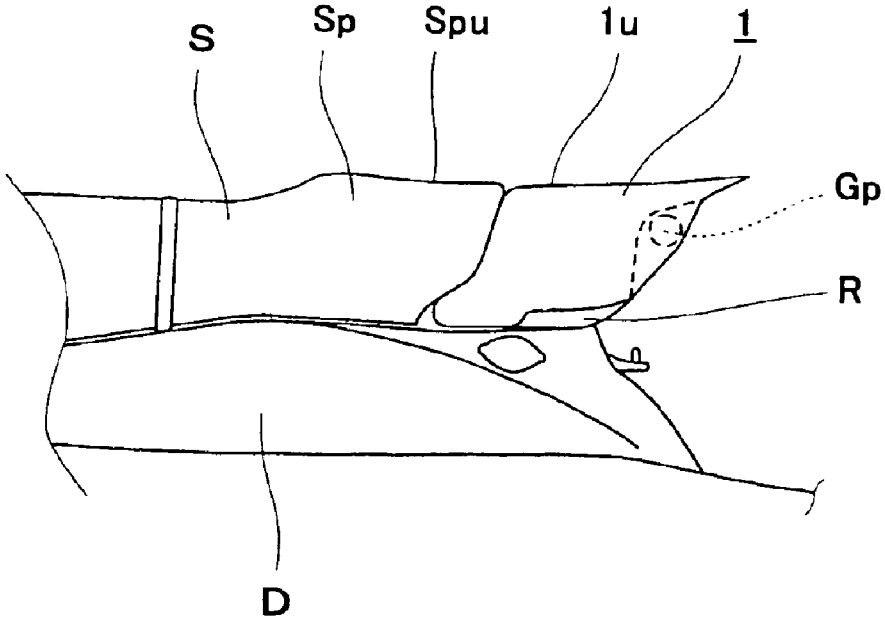
FIG. 3 is a partial side view of an upper portion of a rear end of a personal watercraft, showing a structure of a rear cowling portion according to another embodiment.

Alternatively, as shown in FIG. 3, the upper end face 1u of the rear cowling 1 may be as high as the upper end face Spu of the passenger seat portion Spu of the seat S. Also, in this structure, the accommodating portion can be formed in the box portion 1B as described with reference to FIGS. 1 and 2. In addition, the external design appearance of the watercraft is improved and the commercial value is increased. In FIG. 3, R denotes a suction port formed between the deck D and the rear cowling 1, through which the ambient air is taken into the chamber 20 (see FIG. 17).

Figure 4:
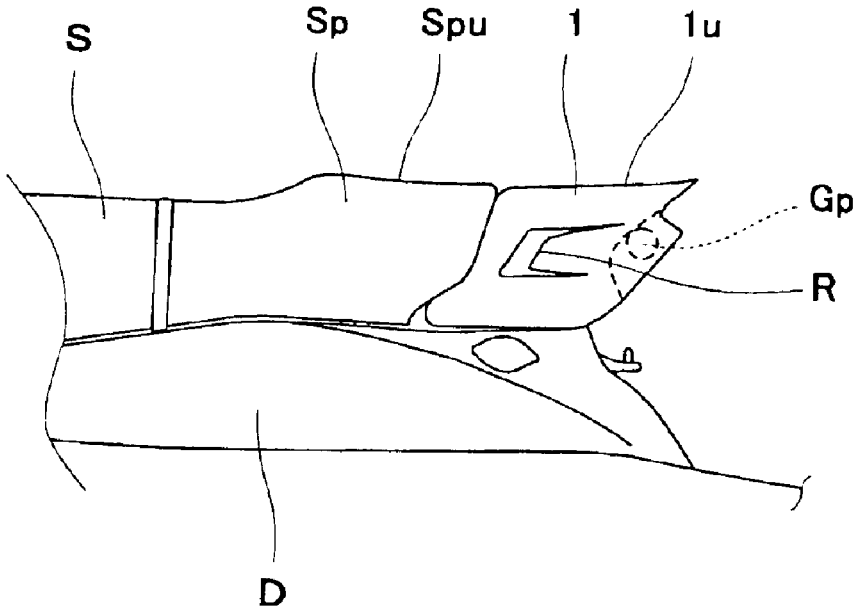
FIG. 4 is a partial side view of an upper portion of a rear end of a personal watercraft showing a structure of a rear cowling portion according to another embodiment.

As shown in FIG. 4, the gap (suction port) R may be provided at a proper position of a side face of the rear cowling 1 or the like. In FIG. 4, the same reference numerals as those in FIG. 3 are used to identify the same or corresponding parts.

Figure 5:
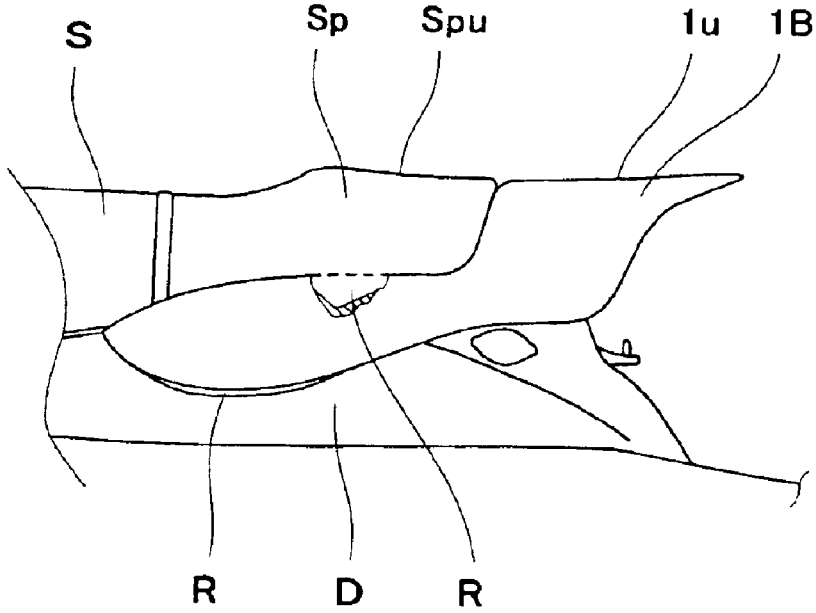
FIG. 5 is a partial side view of an upper portion of a rear end of a personal watercraft, showing a structure of a rear cowling portion according to another embodiment.

Alternatively, as shown in FIG. 5, the rear cowling 1 may be configured such that the upper end face 1*u* is substantially coplanar with the upper end face Spu of the passenger seat portion Sp. In the other respects, the rear cowling 1 in FIG. 5 is identical in structure to the rear cowling in FIG. 1. In the case of the rear cowling 1 in FIG. 5, the passenger can ride on the watercraft in the state in which his/her hip protrudes rearwardly from the passenger seat portion Sp of the seat S. The other functions and effects are identical to those of the rear cowling 1 in FIG. 1. In FIG. 5, the same reference numerals as those in FIG. 1 or 2 to 4 are used to identify the same or corresponding parts.

Figure 6:
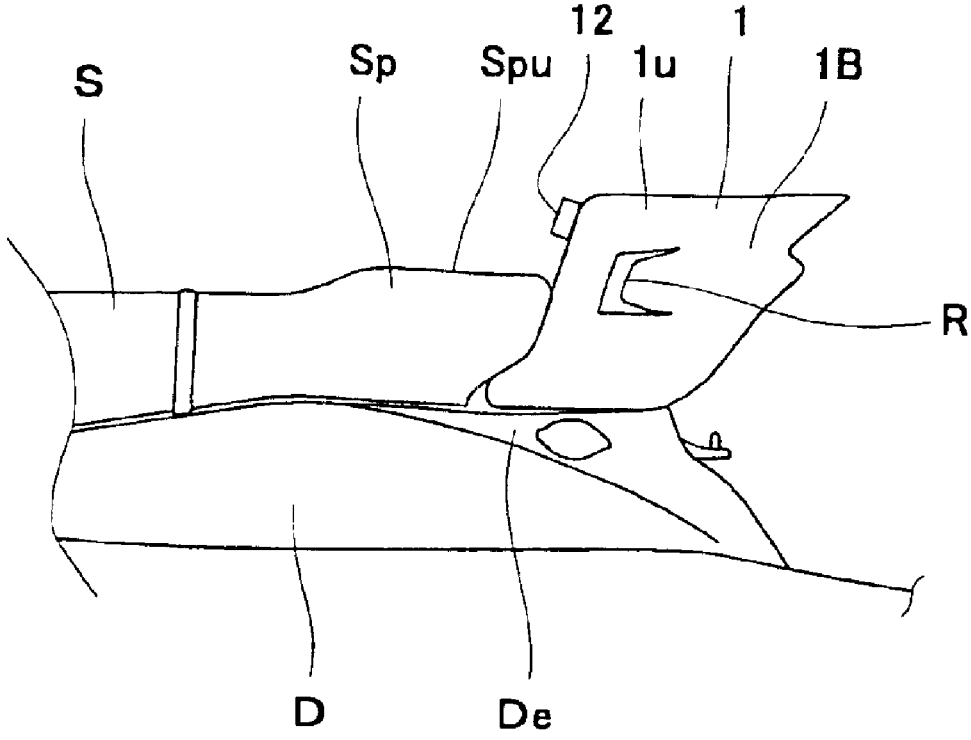
FIG. 6 is a partial side view of an upper portion of a rear end of a personal watercraft, showing a structure of a rear cowling portion according to another embodiment.

Alternatively, as shown in FIG. 6, the rear cowling 1 having substantially the same shape as that of FIG. 4 may be configured such that the upper end face 1*u* of the rear cowling 1 is significantly higher than the upper end face Spu of the passenger seat portion Sp. With this configuration, in addition to the functions and effects of the rear cowling 1 in FIG. 4, the hip or waist of the passenger can be supported from behind. Also, preferably, the internal volume of the accommodating portion inside the box portion 1B can be increased. In FIG. 6, the same reference numerals as those in FIGS. 1 to 4 are used to identify the same or corresponding parts.

The rear cowling 1 in each of the above embodiments may be made of various kinds of materials such as fiber reinforced plastic (FRP), plastic, light metal plate such as aluminum plate, or general steel plate.

The rear cowling 1 is preferable in that it is optionally attached to the commercially available personal watercraft and improves its external design appearance.

Using the rear cowling 1, the ambient air is taken into the chamber 20 as described below. As described above, in the structure in FIG. 1, the gap (suction port) R through which the ambient air is suctioned into the chamber 20 is provided between an inner face of a side portion 1s of the rear cowling 1 and the outer faces of the raised portion De of the deck D and the passenger seat portion Sp.

The gap R is closed at its upper end portion by making the inner face of the rear cowling 1 contact the outer face of the passenger seat portion Sp. As a matter of course, the gap R may be closed at its upper end by the upper end portion of the rear cowling. It should be appreciated that the gap R may be closed at its upper end portion by making the inner face of the rear cowling 1 contact the raised portion De of the deck D.

Below the box portion 1B, the air-intake chamber Se is formed between the bottom portion of the box portion 1B of the rear cowling 1 and a top face Tf of the rear end portion of the raised portion De of the deck D. The top face Tf forms a bottom face of the air-intake chamber Se. A side peripheral wall of the air-intake chamber Se is formed by the rear cowling 1. Two tubular openings Oh are formed in the top face Tf in right and left portions such that their upper opening ends protrude upwardly from the top face Tf. To lower opening ends of the two openings Oh extending downwardly, upper ends of the air pipes 2 are respectively connected.

In this structure, the air pipes 2 and tubular spaces of the openings Oh constitute an air passage.

Alternatively, the air passage may be formed by upwardly protruding the upper ends of the air pipes 2 from the top face Tf. To obtain such air passage, a seal for water proof is needed in the portion where the openings Oh and the air pipes 2 are connected. The air passage does not necessarily protrude upwardly.

In this structure, the air pipes 2 extend obliquely downwardly in the width direction and their lower ends extend to the lower end portion of the chamber 20 located below the air-intake chamber Se. That is, the two air pipes 2 cross each other in the width direction as indicated by a broken line in FIG. 1 or 7. It should be appreciated that the two air pipes 2 may cross each other as shown in FIG. 9.

The air pipe 2 in FIG. 1 has a sub-assembly structure in which the two air pipes 2 are integral with each other. The two air pipes 2 may be integrally formed of resin by blow molding. The integrated air pipe 2 of the sub-assembly structure is easily mounted to the body by positioning the two pipes 2 together. In FIG. 9, 2*u* denotes the opening ends of the upper ends of the air pipes 2 (opening ends connected to the lower opening ends of the openings Oh) and 2*b* denotes opening ends of the lower ends of the air pipes 2, which are located at the lower end portion inside the chamber 20.

Figure 7:
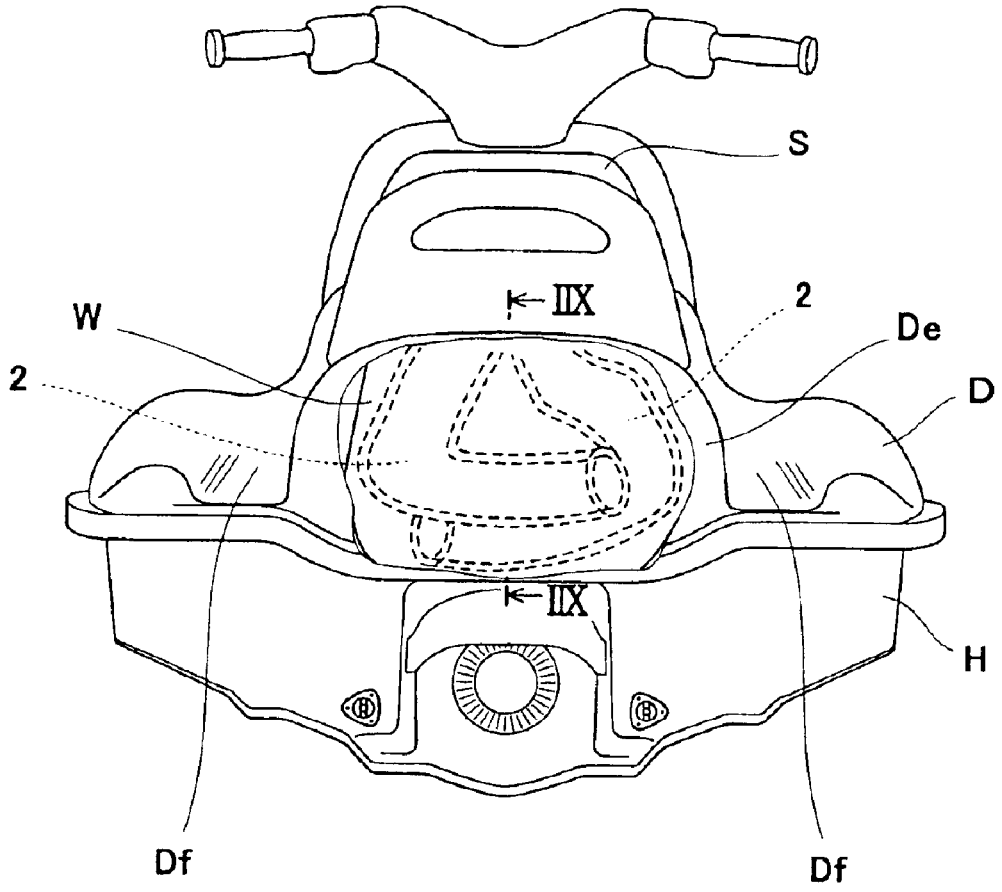
FIG. 7 is a rear view of the personal watercraft, showing a schematic structure of air passages (air pipes) in FIGS. 1 and 8, indicated by a broken line, with a raised portion of the deck partially cutaway to expose a board member.
Figure 8:
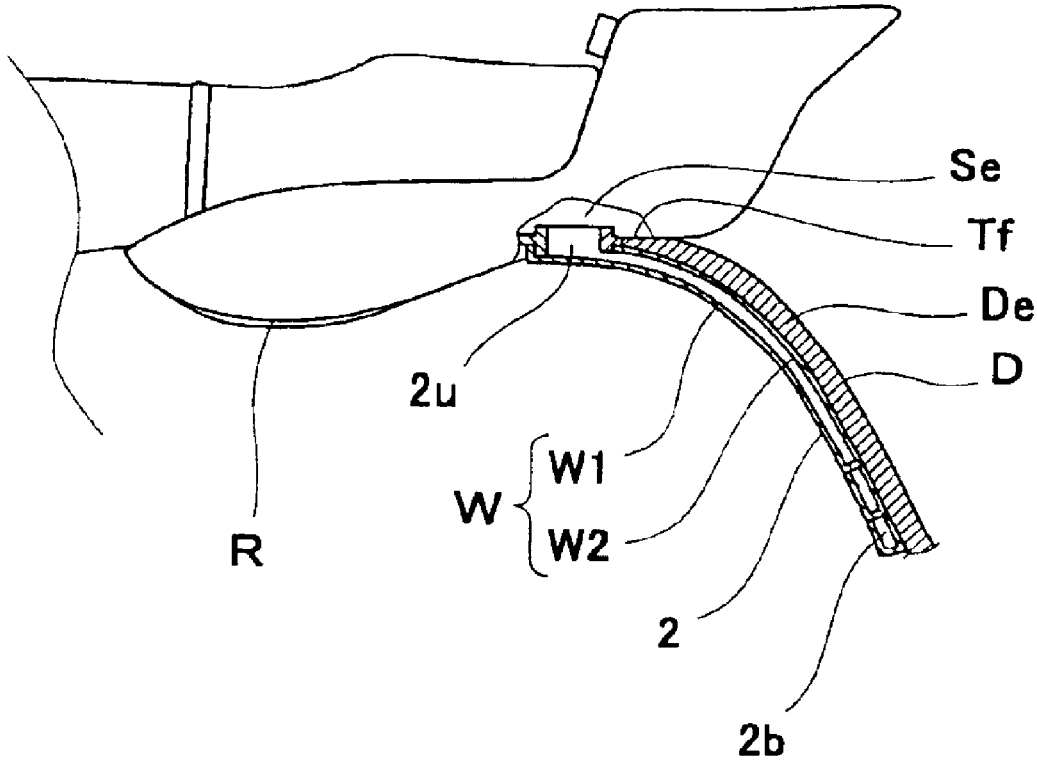
FIG. 8 is a view taken in the direction of arrows along line IIX—IIX in FIG. 7, showing the state in which the air passages in FIG. 7 are disposed in a rear end face of an engine room (inner face of the deck)
Figure 9:
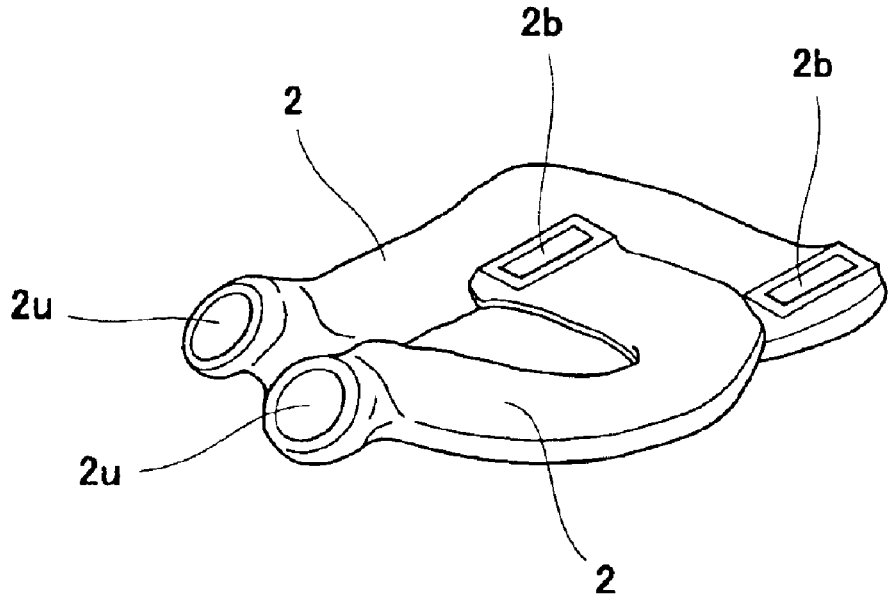
FIG. 9 is a perspective view showing a structure of air passages (air pipes) according to another embodiment.
Figure 10:
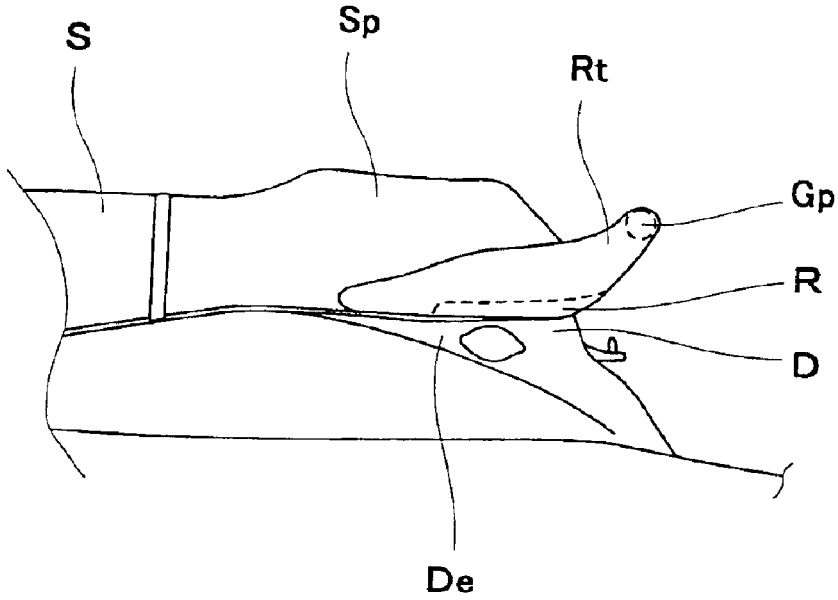
FIG. 10 is a partial side view of a rear end portion of the personal watercraft, showing a mounting portion for mounting a rear attachment having an air-intake structure to a deck according to another embodiment.

As shown in FIG. 8 taken in the direction of arrows along line IV—IV in FIG. 7, two plate members W1, W2 may be bonded to each other and the two air passages 2 in FIG. 7 or 9 may be formed between the members W1, W2, thereby forming a board member W. In this structure, as shown in FIG. 8, merely by attaching (bonding) the board member W to the inner face of the chamber 20 of the deck D, positioning and mounting the two air pipes 2 are easily and quickly accomplished. In FIG. 8, 2*u* denotes upper openings of the air passages 2 and 2*b* denotes lower openings.

In accordance with the personal watercraft so structured, the provision of the rear cowling 1 allows the ambient air to be taken in from the gap R formed between the inner face of the rear cowling 1 and the seat S located inward of the rear cowling 1 or the inner face of the rear cowling 1 and the outer face of the raised portion De of the deck D. The ambient air taken from the gap R flows into the air-intake chamber Se below the box portion 1B of the rear cowling 1. Further, the ambient air is supplied from the air-intake chamber Se into the chamber 20 through the openings Oh and the air pipes 2.

By taking in the ambient air from the lower end of the gap R into the chamber 20 with the above structure in which the gap R is a narrow and long in path, water splash from outside to the rear cowling 1 hardly flows into the air-intake chamber Se through the gap R. This minimizes the water flowing into the chamber 20. Further, since the air-intake chamber Se is formed continuously with the gap R, the air-intake chamber Se is provided with the bottom portion as the top face Tf of the raised portion De, and the openings Oh corresponding to the upper end portions of the air passage protrude upwardly from the top face Tf, the water flowing into the air-intake chamber Se is prevented from further flowing into the chamber 20.

When the watercraft is in an almost inverted state, it might happen that water ingress into the air-intake chamber Se from the gap R occurs. However, since the air pipes 2 extend obliquely downwardly to the lower end portion of the chamber 20 in the width direction, the lower ends of the air pipes 2 are located higher than a waterline of the inverted watercraft. Also, as described above, the air pipes 2 are located obliquely in the width direction. Such structures can minimize the water ingress into the chamber 20.

Instead of the structure of the gap in FIG. 1, as shown in FIG. 3, the gap R may be provided between the lower end of the rear end of the rear cowling 1 and the deck D. Also, as shown in FIG. 2, slits Sr may be provided in the gap R to prevent entry of the water, dust, leaves, or the like from outside the watercraft. Further, alternatively, as shown in FIGS. 4 and 6, the suction port as the gap R may be provided on the side face of the rear cowling 1.

Alternatively, as shown in FIG. 5, the rear cowling 1 in which the box portion 1B does not upwardly protrude may be provided with the gap R in FIG. 1. In FIG. 5, the same reference numerals as those FIG. 1 are used to identify the same or corresponding parts.

Figure 11:
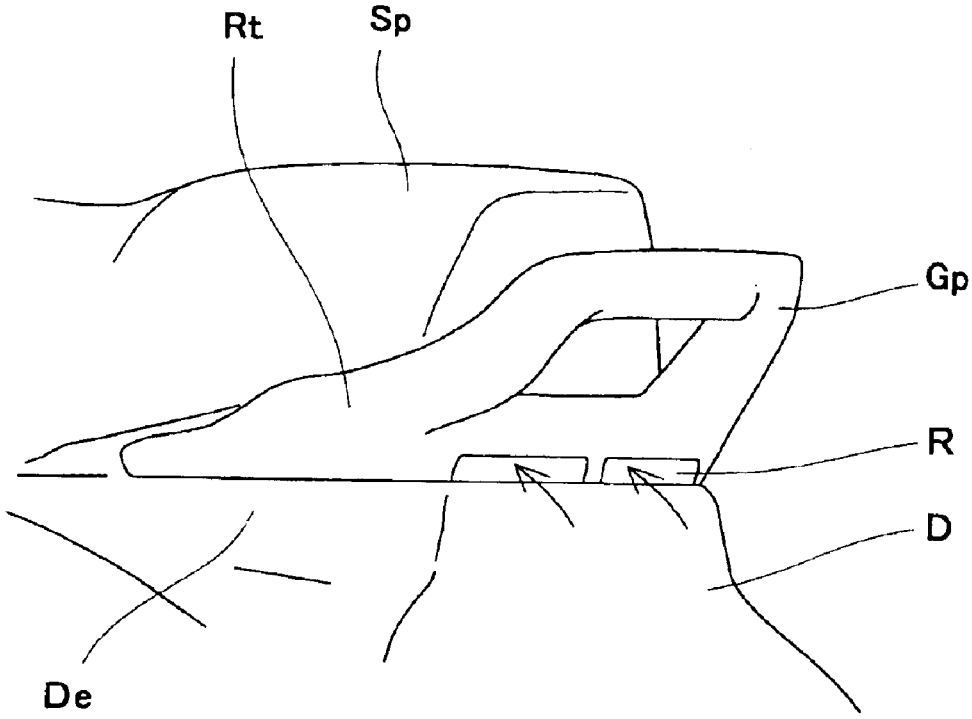
FIG. 11 is a partial perspective view showing the mounting portion of the rear attachment of the watercraft as seen from an obliquely rearward direction and perspectively showing the air-intake structure in FIG. 10.

Instead of the rear cowling 1, a rear attachment having a hand grip may be attached to the rear end portion of the seat S, thereby obtaining an air-intake structure using a mounting portion of the rear attachment. This structure will be described with reference to FIGS. 10 to 13. In this structure, as shown in FIGS. 10 to 13, a rear attachment Rt in substantially C-shape in plan view having a hand grip Gp with which the passenger holds and stabilizes his/her body is provided, at the rear end of the seat S, (i.e., behind the passenger seat portion Sp of the seat S so as to surround a rear portion of the seat portion Sp). As shown in FIG. 11, the gap R is provided between the mounting portion of the rear attachment Rt and the outer face of the raised portion De of the deck D. The gap R may be formed by, for example, slightly cutting a face of the rear attachment Rt in contact with the outer face of the raised portion De, or by recessing or slightly cutting out the outer face of part of the deck D where the rear attachment Rt is attached toward the opposite side of the rear attachment Rt (not shown).

Figure 12:
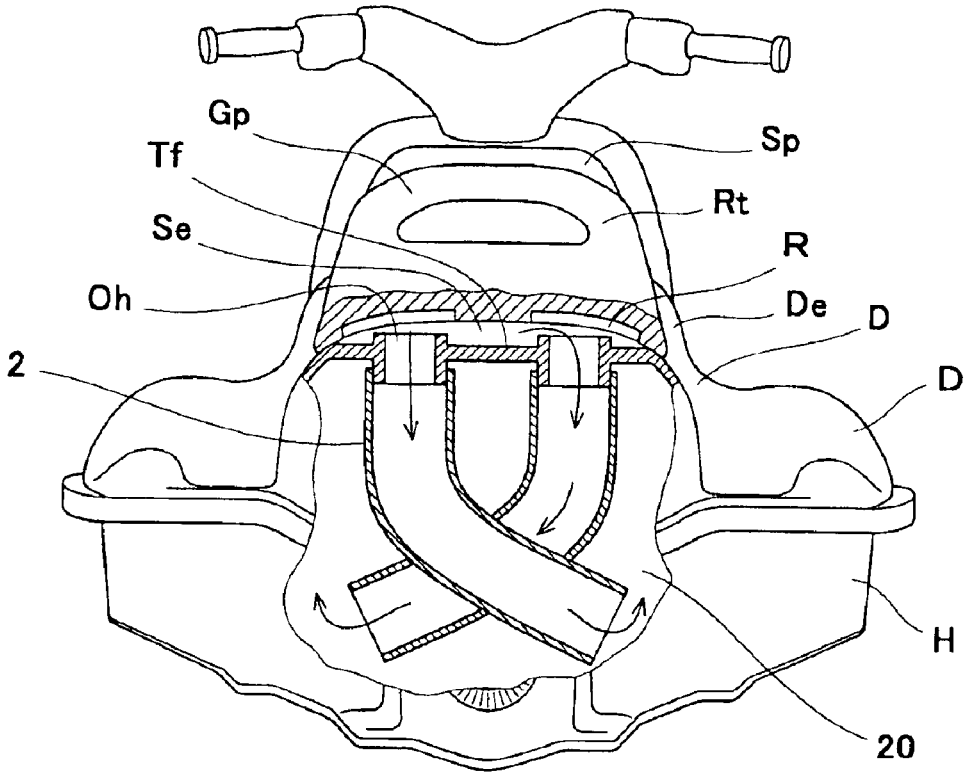
FIG. 12 is a rear view of the watercraft showing a structure of the entire air-intake structure in FIGS. 10 and 11 and an internal structure of an engine room which is partially cutaway.
Figure 13:
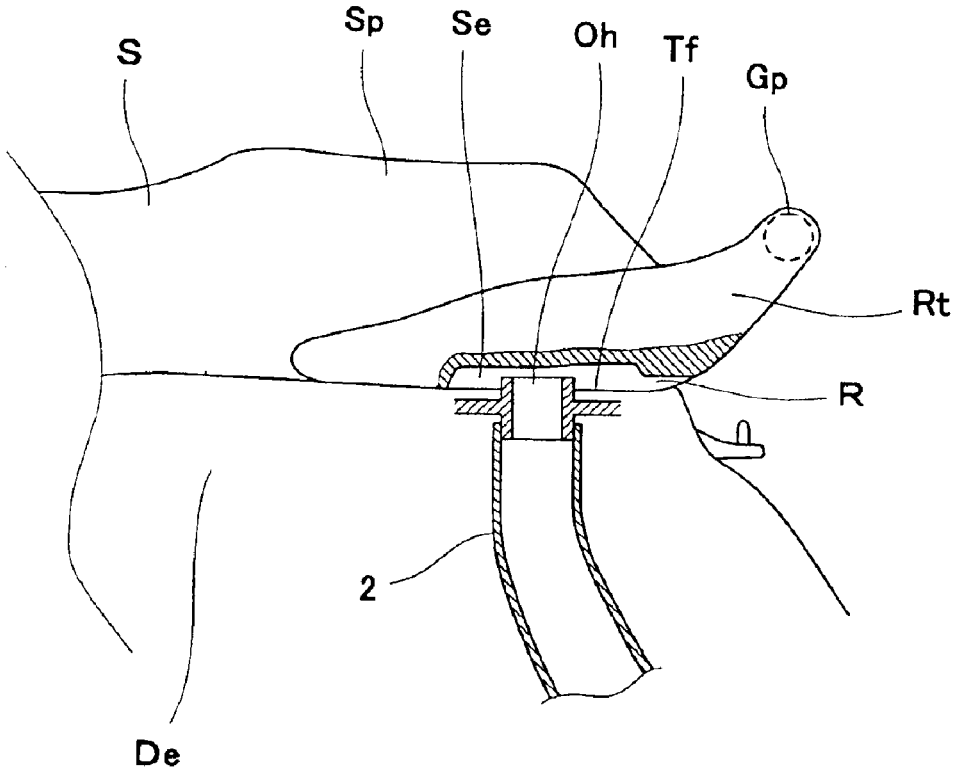
FIG. 13 is a partial cross-sectional view showing a structure from a gap to an air-intake chamber in the air-intake structure in FIGS. 10 and 11.

As shown in FIG. 12 or 13, the gap R is continuous with the air-intake chamber Se formed below the bottom face of the passenger seat portion Sp of the seat S. The air-intake chamber Se has a bottom portion. The bottom portion is formed by the top face Tf of the raised portion De of the deck D and located below the seat S. Two tubular openings Oh are formed in the bottom portion (bottom surface) of the air-intake chamber Se in the lateral direction such that upper opening ends protrude upwardly from the bottom portion and upper end portions of the air pipes 2 are respectively connected to lower end portions of the openings Oh. In this structure, the air pipes 2 and the tubular openings Oh constitute the air passage. Alternatively, the air passage may be formed by upwardly protruding the upper ends of the air pipes 2 from the top face Tf. In this structure, a seal for waterproofing is needed between the air pipes 2 and openings to which the air pipes 2 are connected.

The air pipes 2 extend obliquely downwardly in the width direction. Specifically, in FIG. 12, the air pipe 2 connected to the left opening Oh is inclined downwardly and rightwardly and the air pipe 2 connected to the right opening Oh is inclined downwardly and leftwardly such that their lower ends extend to the lower portion of the chamber 20. The two air pipes 2 are arranged to cross each other in the width direction as shown in FIG. 12.

As described in the above embodiments, the openings Oh and the air pipes 2 may be replaced by the structures in FIGS. 7 to 9. With this structure, the same function and effects as described above are obtained.

Figure 14:
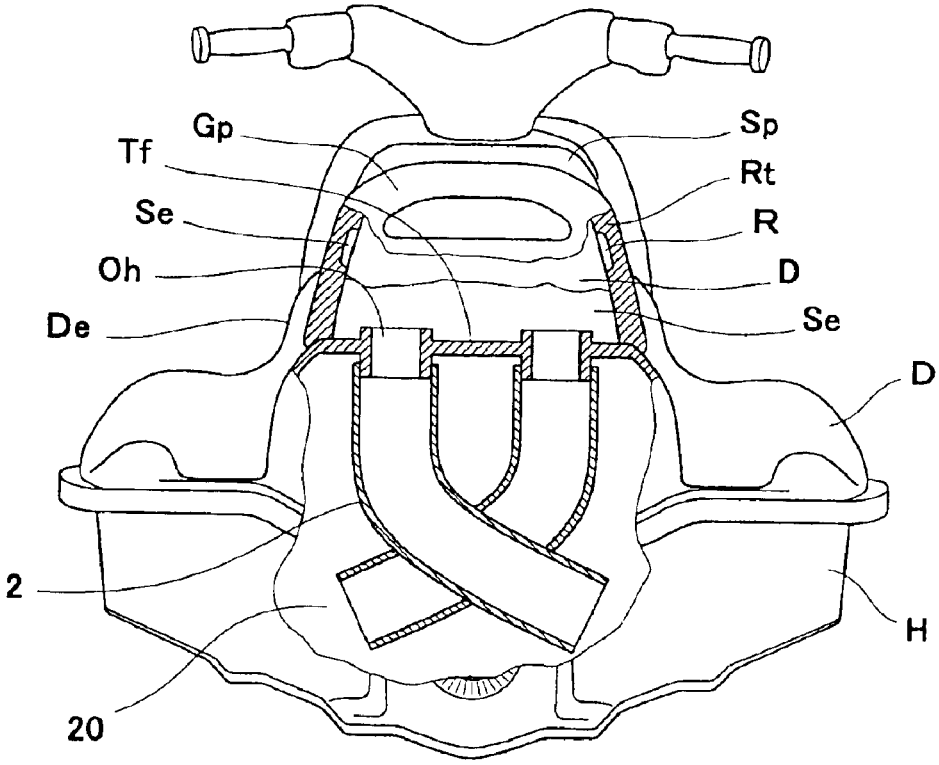
FIG. 14 is a rear view of a personal watercraft, showing an internal structure of an engine room which is partially cutaway, according to another embodiment.
Figure 15:
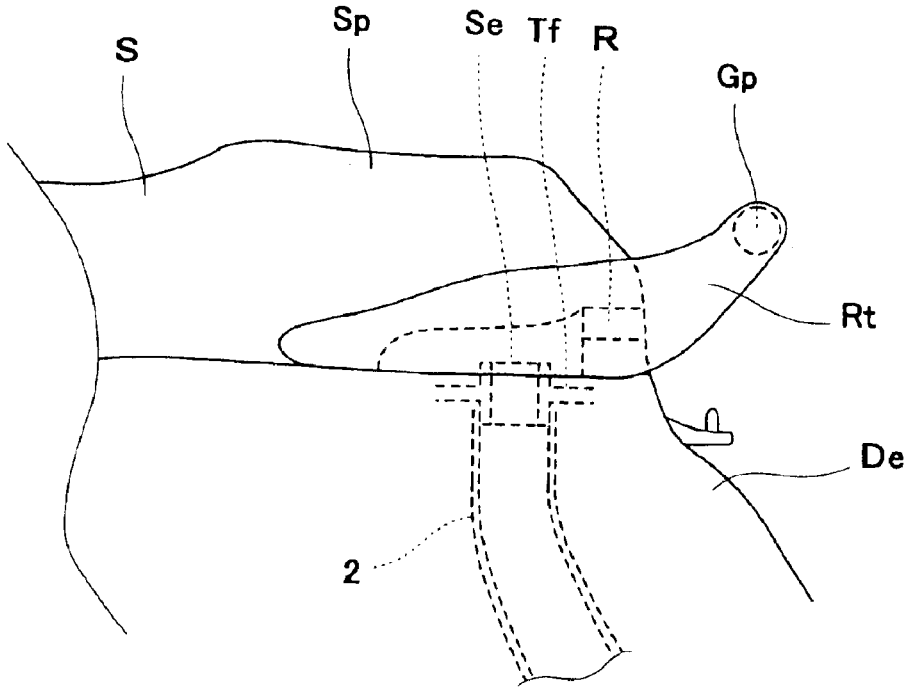
FIG. 15 is a side view showing a rear portion of the watercraft, according to the structure in FIG. 14.

Alternatively, as shown in FIGS. 14 and 15, the gap R communicating with the ambient side may be provided between the inner face of the mounting portion of the side portion of the rear-attachment Rt and the outer face of the raised portion De. In FIGS. 14 and 15, the same reference numerals as those in FIGS. 12 and 13 are used to identify the same or corresponding parts.

According to the personal watercraft so configured, by forming the gap R between the inner face of the hand grip Gp and the outer face of the raised portion De of the deck D, the ambient air is introduced through the gap R into the air-intake chamber Se formed below the bottom face of the passenger seat portion Sp of the seat S. Further, the air is supplied into the chamber 20 through the openings Oh and the air pipes 2. If water splashes from outside to the gap R, it hardly enters the air-intake chamber Se because the gap R is a narrow and long path. And, if the water enters the air-intake chamber Se, it hardly flows into the air pipes 2 because the upper ends of the openings Oh to which the air pipes 2 are connected protrude upwardly from the bottom portion of the air-intake chamber Se, so that water ingress into the air pipes 2 does not occur.

When the watercraft is in the almost inverted state, the gap R and the air-intake chamber Se are immersed in water. However, since the air pipes 2 extend obliquely downwardly in the width direction to the lower end portion of the chamber 20, the lower ends of the air pipes 2 are located higher than the waterline of the inverted watercraft. Such a structure effectively prevents water ingress into the chamber 20.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A personal watercraft propelled by an engine, comprising:

a body;

a hull constituting a lower portion of the body; a deck having deck floors formed on both side portions of the body in a width direction and a raised portion at least extending from a center portion of the body to a rear end portion of the body in a longitudinal direction and being raised from center-side end portions of the deck floors on both sides in a width direction so as to form an engine room inside thereof that contains the engine, the deck covering the hull from above and constituting an upper portion of the body;

a straddle-type seat mounted over an upper end of the raised portion of the deck for a rider to straddle with feet put on the deck floors on both sides; and a rear cowling mounted behind the seat such that a rear portion thereof extends rearwardly from a rear end of the seat and front portion thereof extends downwardly and forwardly from the rear end of the seat to the raised portion of the deck along a side surface of the seat, wherein a gap is formed between the rear cowling and the side surface of the seat and the rear cowling and the raised portion of the deck so as to communicate with an ambient side, and an air-intake chamber is formed within the rear portion of the rear cowling so as to communicate with the gap and allow the air-intake chamber and the engine room to communicate with each other.

2. The personal watercraft according to claim 1, wherein an upper face of the rear cowling is configured to be higher than an upper face of a rear portion of the seat and a cushion member is provided on a front face of the rear cowling.

3. The personal watercraft according to claim 1, wherein an accommodating portion is formed inside the rear cowling and a battery is accommodated inside the accommodating portion of the rear cowling.

4. The personal watercraft according to claim 1, wherein a handgrip member is attached to a rear portion of the rear cowling.

5. The personal watercraft according to claim 1, wherein the air-intake chamber is connected to the engine room through an air passage and an upper end of the air passage upwardly protrudes from a bottom portion of the air-intake chamber.

6. The personal watercraft according to claim 1, wherein the air-intake chamber is connected to the engine room through the air passage and a lower end of the air passage extends to a lower portion inside the engine room.

7. The personal watercraft according to claim 1, wherein the air-intake chamber is connected to the engine room through two air passages which are arranged so as to cross each other.

8. A personal watercraft propelled by an engine, comprising:

a body;

a hull constituting a lower portion of the body;

a deck having deck floors formed on both side portions of the body in a width direction and a raised portion at least extending from a center portion of the body to a rear end portion of the body in a longitudinal direction and being raised from center-side end portions of the deck floors on both sides in a width direction so as to form an engine room inside thereof that contains the engine, the deck covering the hull from above and forming an upper portion of the body;

a straddle-type seat mounted over an upper end of the raised portion of the deck for a rider to straddle with feet put on the deck floors on both sides;

a rear attachment mounted behind the seat and having a hand grip configured to be held by a passenger straddling a passenger seat, the passenger seat being formed in a rear portion of the seat;

a gap formed between the rear attachment and an outer face of the raised portion of the deck to communicate with ambient air outside the watercraft; and an air-intake chamber provided within the rear attachment so as to communicate with the gap and to communicate with the engine room.

9. The personal watercraft according to claim 8, wherein the air-intake chamber is connected to the engine room through an air passage and an upper end of the air passage upwardly protrudes from a bottom portion of the air-intake chamber.

10. The personal watercraft according to claim 8, wherein the air-intake chamber is connected to the engine room through the air passage and a lower end of the air passage extends to a lower portion inside the engine room.

11. The personal watercraft according to claim 8, wherein the air-intake chamber is connected to the engine room through two right and left air passages arranged to cross each other.

12. The personal watercraft according to claim 11, wherein the right and left air passages are integral with each other and attached to an inner face of the deck.

13. The personal watercraft according to claim 10, wherein the air passage is formed integrally inside a board member and the board member is attached to the inner face of the deck.

14. A personal watercraft propelled by an engine, comprising:

a body;

a hull constituting a lower portion of the body;

a deck having deck floors formed on both side portion of the body in a width direction and a raised portion at least extending from a center portion of the body to a rear end portion of the body in a longitudinal direction and being raised from center-side end portions of the deck floors on both sides in a width direction so as to form an engine room inside thereof that contains the engine, the deck covering the hull from above and constituting an upper portion of the body;

a straddle-type seat mounted over an upper end of the raised portion of the deck for a rider to straddle with feet put on the deck floors on both sides; and a rear cowling mounted behind the seat and extending rearwardly from a rear end of the seat;

wherein an accommodating portion is formed inside the rear cowling and a battery is accommodated inside the accommodating portion of the rear cowling.

* * * * *